United States Patent [19]

Bartkowicz

[11] Patent Number: 5,035,428

[45] Date of Patent: Jul. 30, 1991

[54] ROTATING GRIP FOR A BASEBALL BAT

[76] Inventor: Robert J. Bartkowicz, 3 Canal St., Sayreville, N.J. 08872

[21] Appl. No.: 450,159

[22] Filed: Dec. 13, 1989

[51] Int. Cl.[5] ..... A63B 59/06

[52] U.S. Cl. ..... 273/72 R; 273/72 A; 273/26 B; 273/81 C

[58] Field of Search ..... 273/81 C, 81 B, 72 R, 273/72 A; 74/551.9; 81/489

[56] References Cited

U.S. PATENT DOCUMENTS

| | | | |
|---|---|---|---|
| 1,305,952 | 6/1919 | Suesman | 273/81 C |
| 2,225,839 | 12/1940 | Moore, Jr. | 273/81 CX |
| 2,471,610 | 5/1949 | Christensen | 273/72 R |
| 2,984,486 | 5/1961 | Jones | 273/72 R |
| 3,804,413 | 4/1974 | Hrivnak | 273/81 C |
| 4,919,420 | 4/1990 | Sato | 273/81 B |

*Primary Examiner*—Theatrice Brown
*Assistant Examiner*—M. Graham
*Attorney, Agent, or Firm*—Stephen W. White

[57] ABSTRACT

A rotating grip comprising a non-slip outer surface and a high slip inner surface and which can be installed on the handle of a baseball bat to enhance the user thereof, is described. The grip can be covered by a conventional sleeve-type grip and has a novel notching means to hold the rotating grip in place. When used, the rotating grip enables the proper alignment of the hands to occur automatically and thus create a level and smooth swing. This swing will insure more direct hits on the baseball.

3 Claims, 2 Drawing Sheets

ROTATING GRIP FOR A BASEBALL BAT

BACKGROUND OF THE INVENTION

1. Cross-Reference to Related Applications

This application is related to my co-pending application, U.S. Ser. No. 07/093,243, filed in the U.S. Patent Office on Sept. 4, 1987, now abandoned, and is an improvement thereover.

2. Field of the Invention

This application is related to the game of baseball and more particularly, this application is related to the baseball bat used therein. Still more particularly, this invention is related to the grip of said baseball bat. Even more particularly, this invention is related to a method for improving the swing of the user thereof thus producing a more efficient swing.

3. Discussion of the Prior Art

There are a host of prior art references which describe various forms of games in which a ball is struck by some sort of instrument. Most of these instruments have some sort of gripping arrangement in order to improve the grip of the user thereof. For example, tennis racquets and golf clubs are all instruments which are designed to strike a ball during the playing thereof. These instruments all have some sort of grip arrangement located on the handle in order to improve the grip and the swing during use. Baseball is a game that is also played with an instrument to strike a ball. This instrument called a baseball bat, has a large end which strikes the ball during use and a smaller end that is gripped by the user. Various prior art references describe the use of gripping aids on baseball bats. These may be in the form of tape or the like or some sort of rubber sleeve that is slipped on over the gripping area to improve the grip of the user, for example. It is important in baseball to maintain a steady, level swing when using this bat. Since the grip on the handle of the baseball bat is achieved using both hands, and since the swing of the bat is from the shoulders in a motion essentially parallel with the ground or playing surface, it is vital that this grip be positioned correctly to maintain the requisite level, even swing. To achieve this correct grip, the player normally will insure that the finger knuckles of both hands are in alignment with each other so that the swing may be accomplished with the full extension of the elbows, for example. In my previously filed application, I described an element which could be applied to the gripping end of the baseball bat under a standard grip and at a predetermined distance from the end of the grip. This device is properly located for one of the players hands and rotates during the swing of the bat to provide the requisite alignment of the hands.

However, all of these prior art references suffer from some sort of deficiency. A standard grip only improves the overall grip of the user and does nothing to insure proper alignment of the hands. The device described in U.S. Ser. No. 7/093,243 tends to slip during use and move up or down the bat handle thus preventing the proper use thereof. This slipping motion is undesirable since the grip must be placed in proper position at almost every use. Thus, there are no prior art elements which can be used to improve the grip on a baseball bat and at the same time improve the swing of the user thus resulting in more and better hits on the ball.

SUMMARY OF THE INVENTION

It is an object of this invention to provide an improved gripping member for the handle of a baseball bat. It is yet another object to provide an improved, rotating gripping member which can be easily installed and will not slip up or down during use. These and yet other objects are achieved by providing a thin, flexible, flat gripping element comprising two layers the first layer comprising an outer, gripping, non-slip surface and the second layer comprising an inner facing having a high slip surface, said element having a notching means at the ends thereof so that when said element is wrapped around the handle of a baseball bat with said inner facing on said handle with said gripping, non-slip surface supra thereto, and a cover applied thereon, said element will remain on said handle when force is applied thereto.

DETAILS OF THE INVENTION

Figure 1:
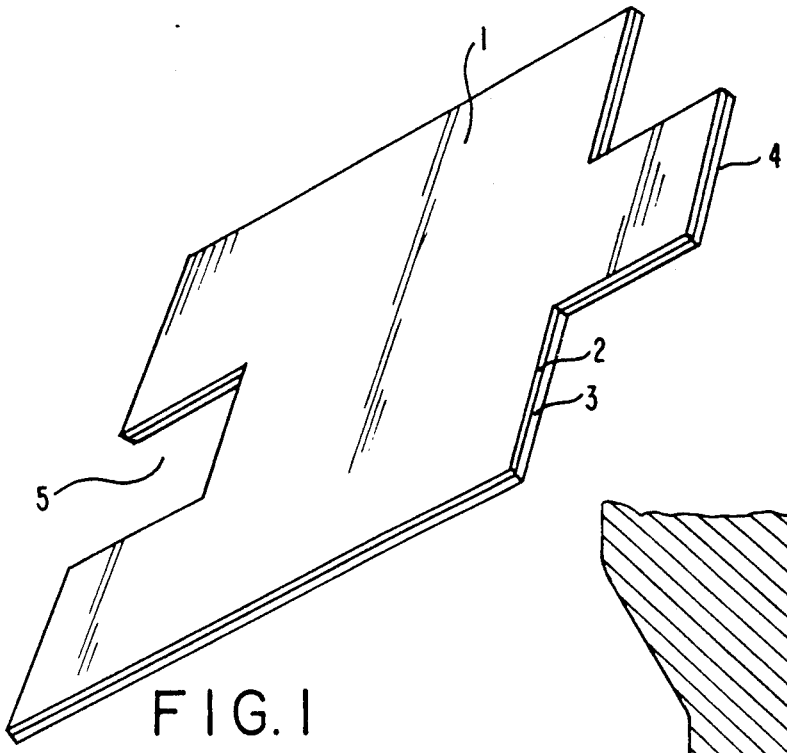
FIG. 1 is a showing of the flat, flexible gripping means of this invention.

Referring now specifically to the drawings which particularly exemplify the essence of what I have discovered, FIG. 1 is a perspective view of the thin, flexible, flat gripping element of my invention 1 wherein 2 is the outer layer which provides a gripping, non-slip surface and 3 is the inner facing having a high slip surface associated therewith. In this view, the notching means are shown as 4 and 5. This thin, flexible, flat gripping element is ready to be wrapped around the handle of a baseball bat and positioned properly for the hand of the user thereof. When so wrapped, the notching means engage which prevents the entire element from twisting and slipping down out of position.

Figure 2:
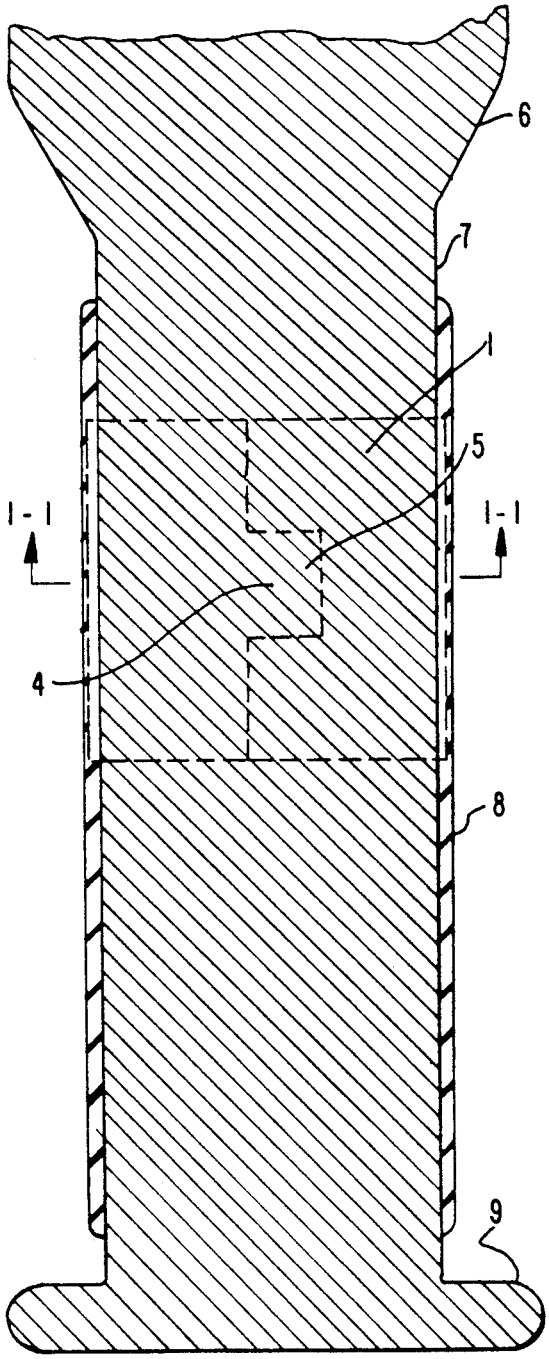
FIG. 2 is a showing of the gripping means of FIG. 1 installed on the handle of a baseball bat.

FIG. 2 shows the element of FIG. 1 installed over the handle of a baseball bat. In this view, the thin, flexible, flat gripping element 1 with the notching means 4 and 5 properly mated, is shown on the handle 7 of a baseball bat 6. In this figure, 8 is a conventional baseball bat handle cover or sleeve which is placed over the gripping element of my invention and 9 is the conventional enlarged end of the baseball bat. This enlarged end is placed to properly hold the hands of the user from disengaging therefrom.

Figure 3:
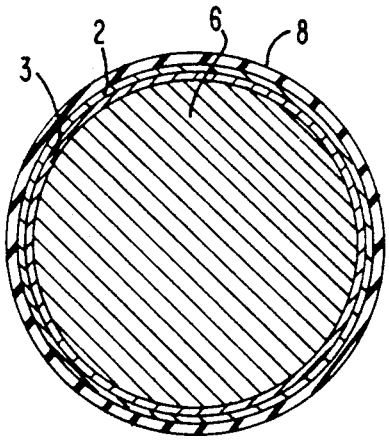
FIG. 3 is a cross-sectional view of FIG. 2.

FIG. 3 is a cross-sectional view cut through 1—1 of FIG. 2. In this showing, the solid portion 6 represents the baseball bat 2 and 3 the two layers of the gripping element of this invention, and 8 the flexible, conventional grip applied supra thereto.

Figure 4:
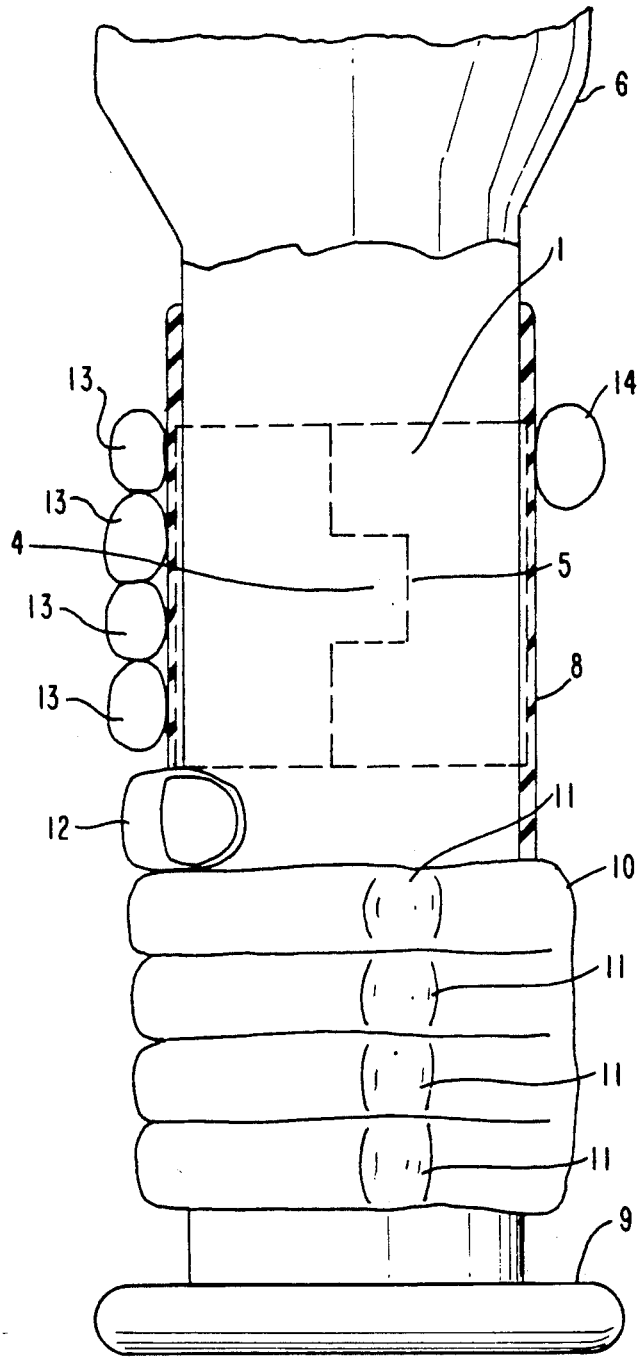
FIG. 4 is the same view of FIG. 2 but additionally showing the hands of the user gripping said handle of said baseball bat.

FIG. 4 is another showing of FIG. 2 wherein the left hand of the user 10 is already in place with the knuckles thereof 11 shown in an aligned position and the thumb as 12. The digits 13 and thumb 14 of the right hand are shown in position to slide over the gripping element of my invention 1 which has been installed and notched as shown in FIG. 2. If this hand were shown already in place, one could not see said gripping element. As this hand is positioned by the user, the knuckles may or may not align with the knuckles of the left hand, in this showing. But, when the user begins to swing the baseball bat, either in warm-up or in actual use, the gripping element of my invention will rotate slightly so as to cause the proper alignment of both hands.

In actual use, the gripping element of this invention should be about the size of a normal hand. Of course, hands vary in size and thus, the element can also vary in size and can be either customed fitted to the hand of the user or made an average size, for example. The notching means as shown in the drawings are shown as rectangular or square in dimension. This may also be semi-circular or "T" shaped, for example. The size and shape of the notching means is not important. However, the presence of a notching means is vital to prevent the entire gripping element from twisting and shifting position on the handle of the baseball bat during use. The preferred method is as shown and in this configuration, it has been thoroughly tested and found to provide the optimum in gripping ability.

The first layer 2 of my gripping element is designed to hold firmly in place and to provide a secure grip for the user. This layer may be comprised any of the conventional, high friction producing materials, such as rubbers, both natural and synthetic, for example. It may be comprised of the same material used in the flexible sleeve installed over conventional baseball bat handles and thus, when this sleeve 8 is in contact therewith, a firm, gripping relationship is encountered.

On the other hand, the second, inner layer 3, which faces the handle of the baseball bat 7 itself, must be able to slip or rotate thereon when the user makes a swing. The material from which this layer is constructed may be conventional, low friction materials such as polytetrafluroethylene or even polyethylene, among many others. I prefer the former material since it has a low coefficient of friction as measured against the conventional baseball bat handle, for example.

Thus, when the notched element of this invention is installed over the handle of a baseball bat as shown in the figures attached hereto, it can be positioned for either hand of the user. A flexible, conventional sleeve used on the gripping handle of the bat may be installed over the element of this invention. This sleeve will hold my rotating grip firmly in place for use and is much preferred. However, any means for holding the rotating grip in place may also be used. For example, the grip may be taped in place or the notching means glued to prevent unraveling, for example. Any means to hold the rotating grip in place for the hand of the user may be utilized. Naturally, the conventional sleeve or grip of a baseball bat is preferred since it also prevents the slipping of the hands during use. Additionally, it permits an easier installation of my rotating grip and also permits easy change of the position thereof. For example, if the user decides to "choke up" on the handle of the bat or to move the position of the hands during use, it is a simple matter to roll down the sleeve and reposition the rotating grip to accommodate the requisite hand position.

The use of my rotating grip enhances the playing of the game of baseball from the position of the batter. Since the knuckles of both hands will align properly, the swing of the bat is even and from the shoulders. A user will find that the swing of the bat is more level so that contact with the incoming pitched ball is square. This permits more hits of a line-drive type and less of the so-called "pop-ups". This effect also permits the bat to be in the hitting area or strike zone longer thus insuring more hits on the ball. In an actual test thereof, a single user hitting with and without the rotary grip of my invention found that the ball was struck more often and the ball travelled further on average after being hit with the bat containing the rotary grip. In addition, by using the rotary grip, a user may be able to enhance their swing more and thus be able to hit more effectively using the opposite hand. Thus, a right hand hitter may be able to swing from a left handed position and feel more comfortable with rotary grip installed than without. This occurs since the rotary grip enhances the grip of the user, properly aligning the hands thereof. Since this is even harder to do when batting with the opposite hand position, the use of the rotary grip will enhance the ability of the user to bat from the opposite stance, for example.

I claim:

1. A rotating gripping element adapted to be wrapped around the handle of a baseball bat, said handle having a flexible cover applicable thereover, said rotating gripping element being covered by said cover and comprising a thin flexible, flat material having two layers, the first layer comprising an outer, gripping, non-slip surface and the second layer comprising an inner facing adapted to face the surface of the bat handle and having a high slip surface, said gripping element having a notching means so that when said gripping element is wrapped around said handle of said bat, with said inner facing on said handle, with said gripping, non-slip surface supra thereto, said notching means are engaged so that when said cover is applied thereover, said rotating gripping element will remain on said handle when force is applied thereto.

2. The gripping element of claim 1 wherein said first, non-slip layer is comprised of rubber and said second high slip layer is comprised of polytetrafluoroethylene.

3. The gripping element of claim 1 wherein said notching means are square or rectangular in shape.

* * * * *